US006840978B2

(12) United States Patent
Matsuura et al.

(10) Patent No.: US 6,840,978 B2
(45) Date of Patent: Jan. 11, 2005

(54) POROUS METAL ARTICLE, METAL COMPOSITE MATERIAL USING THE ARTICLE AND METHOD FOR PRODUCTION THEREOF

(75) Inventors: Takahiro Matsuura, Itami (JP); Keizo Harada, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 56 days.

(21) Appl. No.: 10/343,117

(22) PCT Filed: Apr. 25, 2002

(86) PCT No.: PCT/JP02/04181

§ 371 (c)(1),
(2), (4) Date: Jan. 28, 2003

(87) PCT Pub. No.: WO02/100582

PCT Pub. Date: Dec. 19, 2002

(65) Prior Publication Data

US 2003/0200837 A1 Oct. 30, 2003

(51) Int. Cl.[7] ..... B22F 3/00

(52) U.S. Cl. ..... 75/240; 75/244; 75/245; 419/2; 419/14; 419/23; 419/27; 419/40

(58) Field of Search ..... 75/240, 244, 245; 419/2, 14, 23, 27, 40

(56) References Cited

U.S. PATENT DOCUMENTS 5,679,041 A * 10/1997 Sokol et al. ..... 442/59
6,387,149 B1 5/2002 Harada et al. ..... 75/239
6,402,488 B2 6/2002 Watanabe et al. ..... 418/178

FOREIGN PATENT DOCUMENTS

| | | |
|---|---|---|
| JP | 38-17554 | 9/1938 |
| JP | 57-174484 | 10/1982 |
| JP | 2-19406 A | 1/1990 |
| JP | 6-89376 | 11/1994 |
| JP | 8-319504 | 12/1996 |
| JP | 9-122887 | 5/1997 |
| JP | 9-231983 | 9/1997 |
| JP | 10-46268 A | 2/1998 |
| JP | 10-183203 | 7/1998 |
| JP | 10-251710 | 9/1998 |
| JP | 2001-226723 | 8/2001 |

* cited by examiner

*Primary Examiner*—Ngoclan T. Mai
(74) *Attorney, Agent, or Firm*—McDermott, Will & Emery

(57) ABSTRACT

A porous metal body having a foam structure of 500 μm or less in average pore diameter, wherein the skeleton is composed of an alloy primarily including Fe and Cr, and Cr carbide or FeCr carbide is uniformly dispersed in the texture. The metal porous body is produced by preparing a slurry primarily containing an Fe oxide powder having an average particle diameter of 5 μm or less, at least one powder selected from metallic Cr, Cr alloys, and Cr oxides, a thermosetting resin, and a diluent, applying a coating of this slurry to a resin core body having a foam structure, performing drying, and thereafter, performing firing in a non-oxidizing atmosphere so as to produce a metal porous body having the aforementioned skeleton structure.

27 Claims, 3 Drawing Sheets

POROUS METAL ARTICLE, METAL COMPOSITE MATERIAL USING THE ARTICLE AND METHOD FOR PRODUCTION THEREOF

TECHNICAL FIELD

The present invention relates to a metal porous body which is composed of an alloy having high strength, excellent corrosion resistance, and excellent heat resistance and which is applied to electrode substrates, catalyst supports, filters, metallic composite materials, etc., and also relates to a metallic composite material using the same and a method of manufacture thereof.

BACKGROUND ART

Metal porous bodies have been used thus far in various applications, for example, filters required to have heat resistance, electrode plates for batteries, and furthermore, catalyst supports, and metallic composite materials. Therefore, manufacturing techniques for metal porous bodies have been known through many publicly known literatures. Furthermore, products using CELMET (registered trade name) manufactured by Sumitomo Electric Ind., Ltd., which is a Ni-based metal porous body have been widely used in the industry.

The conventional metal porous body is produced by forming a metal layer on the surface of a foamed resin, etc., and thereafter, firing and removing the resin portion while the metal layer is reduced. For example, according to the method described in Japanese Unexamined Patent Application Publication No. 57-174484, after the surface of a porous core material, for example, a foamed resin, is subjected to a treatment for imparting electrical conductivity, a metal layer is formed by a plating method. For example, according to the method described in Japanese Examined Patent Application Publication No. 38-17554, a slurry containing a metal powder is adhered to the surface of a core material made of a foamed resin, etc., and drying is performed so as to form a metal preliminary layer.

In the former method where the metal layer is formed by the plating method, the treatment for imparting electrical conductivity is performed by adhesion-application of a conductive material, evaporation of a material for imparting electrical conductivity, or surface modification with a chemical agent, etc. Subsequently, the metal layer finally to become a porous metal body is formed by electroplating, or electroless plating, etc. Ultimately, the metal porous body is produced by firing and removing the resin portion which is a porous core material. In the case where an alloyed porous body is produced, different sorts of metal plating layers are formed, and they are subjected to a metal diffusion treatment by heating.

In the latter method, a slurry containing a metal powder and a resin is prepared in advance, which becomes the metal preliminary layer. In this method, an alloy powder or a mixed metal powder composed of a plurality of metals having an alloy composition is used as the metal powder of the slurry, and the porous metal body, which is alloyed by heating after drying, can be produced.

However, regarding the alloyed porous metal body produced as described above, since the adhesion property among the particles of the metal powder is particularly degraded due to oxidation or deterioration of the surfaces of the particles, the mechanical strength of the porous body decreases as compared with that of the porous metal body produced by the former method in which the diffusion alloying treatment is combined after plating.

An example of improvement in terms of such drawback, targeting at a porous iron alloy body is disclosed in Japanese Patent Publication No. 6-89376. According to the method, a specified amount of carbon is contained in the iron powder prepared in advance in the slurry and, in addition, the surface thereof is forced to oxidize. This causes an oxidation-reduction reaction between the oxygen in the oxide and the carbon contained to occur during firing and, as a result, the adhesion property among the metal powder particles is improved.

In addition, a sintered iron porous body having a dense metal skeleton, the raw material of which is an iron oxide powder, is disclosed in Japanese Unexamined Patent Application Publication No. 9-231983. However, even this method, further modification of the metal itself is required in order to enable the porous body to be used as a structural member for which high mechanical strength, heat resistance, and wear resistance are important characteristics. For example, as described in the aforementioned publication, since the characteristics in terms of mechanical strength, corrosion resistance, and heat resistance are inadequate, the improvement of these characteristics is attempted by alloying.

Furthermore, use of porous metal bodies has been accelerated by combination with a casting such as an Al die casting. This combination technique is a method in which a casting of a light metal is melt-infiltrated into gap portions of the porous metal body, and has been used widely as a means for achieving weight reduction by changing the Al alloy to the casting. In this case, further improvement of the characteristic can be expected by alloying the portion primarily containing Al which is to be combined with a porous body primarily containing Fe. Consequently, the same is expected with respect to combination with an alloy of another light metal, for example, Mg.

The technique regarding combination using a metal porous body is disclosed in detail in Japanese Unexamined Patent Application Publication No. 9-122887. According to the description in this publication, such a combined light-metal alloy is used in particular for the part of harsh use, for example, a slide portion, etc. Consequently, the characteristics of the metal porous body itself used for combination are required to coincide with the uses.

The aforementioned CELMET has been used as the metal porous body used for combination with the light metal as described above. However, a technique for producing a material having further excellent performance is described in Japanese Unexamined Patent Application Publication No 10-251710. For producing the porous metal body, a coating of a slurry containing a metal powder and a ceramic powder is applied to a member made of a foamed resin capable of being burned off, and subsequently the resin component is burned off in a reducing gas atmosphere containing steam/or carbon dioxide, and furthermore, the temperature is raised so as to perform firing in the reducing atmosphere. As a result, ceramic particles are dispersed in the skeleton of the resulting porous metal body and, therefore, a porous metal body having superior ceramic characteristics is formed.

In addition to this, there is a porous metal body disclosed in Japanese Unexamined Patent Application Publication No. 8-319504, in which gaps among the powders are used, as a metal powder is molded and sintered to the extent that it does not become dense. In this method, the volume percentage of the porous metal body is 30% to 88%, which is higher than that of the present invention and, therefore, when combination with Al, for example, is performed, a high pressure is required in order to impregnate the interior of the porous metal body with an Al melt. Furthermore, since the proportion of the metal porous body in the composite material becomes large, there is a problem in that a merit of weight reduction is not exerted. Herein, the volume percentage refers to the volume percentage of the skeleton portion relative to the total volume of the porous body.

Some problems in the use of the metallic composite material have been overcome by research regarding metal combination techniques as described above. Recently, such a metallic composite material has been noted and has been used as a material for weight reduction of engine components of automobile, etc. However, regarding this sort of components, requirements of the materials have become increasingly stringent in terms of emission control, etc. For example, further excellent wear resistance has been required of components used for, especially, wear-resistant piston ring portions of diesel engines. A composite material using the aforementioned metal porous body containing ceramic particles is mentioned as a potential material for such a component. However, regarding this material, since ceramic particles are contained in the skeleton of the porous body, preform working becomes difficult compared with that of the common porous body composed solely of metal, and therefore, the shapes, which can be made by working, are restricted.

Most of all, in the case of a component, such as a bore material of an engine block, used under the high-speed sliding condition at a high temperature, improvements of wear resistance, excellent moldability capable of near net preform molding and, in addition, especially, seizing resistance against the sliding counterpart material are very important challenges.

DISCLOSURE OF INVENTION

The present invention was made as a result of research based on a series of requirements in such uses. It is an object of the present invention to provide a composite material having unprecedented seizing resistance, especially, under sliding.

The first thereof is to provide a metal porous body meeting the aforementioned object, and the porous body has a foam structure, wherein the skeleton thereof is composed of an alloy including Fe and Cr while Cr carbide and/or FeCr carbide is uniformly dispersed therein, and the pore diameter thereof is 500 μm or less. The amount of contained metal carbide can be determined based on the amount of carbon, and when the carbon content in the skeleton of the porous metal body is not less than 0.1% by mass and not more than 3.5% by mass, the porous metal body has especially preferable characteristics. When the metal porous body has the aforementioned composition and texture, unprecedentedly excellent mechanical strength is brought about. In particular, it is preferable that the amount of the carbides be within the aforementioned range in terms of carbon content. When the amount of carbon is less than 0.1% by mass, since the amount of carbides in the skeleton is small, the wear resistance decreases, and when it exceeds 3.5% by mass, the skeleton itself becomes hard, it becomes difficult to perform preform working and, furthermore, aggressiveness against the counterpart sliding member may be increased.

The amount of carbon is more preferably within the range of 0.3% by mass to 2.5% by mass.

In the aforementioned preferable range of the amount of carbon, that is, within the range of 0.1% to 3.5% by mass, the Vickers hardness of the skeleton portion of the porous metal body is within the range of 140 to 350 and, therefore, good results are brought about particularly in wear resistance and workability after combination alloying.

When at least one selected from the group consisting of Ni, Cu, Mo, Al, P, B, Si, and Ti is included in the skeleton of the metal porous body according to the present invention, toughness is increased and, therefore, more preferable results are brought about. The desirable content thereof is 25% by mass or less in the total amount.

Regarding the porous body according to the present invention, the pore diameter of the metal skeleton is controlled at 500 μm or less. According to this, especially, seizing resistance after combination with the light metal is improved remarkably. In particular, when it is controlled within the range of 100 μm to 350 μm, impregnation of a light metal melt is facilitated and, in addition, it is preferable from the viewpoint of improvement of the seizing resistance.

A second object of the present invention is to provide a composite material which is composed of a porous metal body and a light metal alloy and which meets the aforementioned object. The composite material is such that the inside of the pores having pore diameters within the aforementioned range of the porous metal body described above is filled with an Al alloy or a Mg alloy. The composite material is produced, as will be described in detail later, by pressure-impregnating the pores having controlled pore diameters of the aforementioned porous metal body with a melt of Al alloy or Mg alloy.

By designing the pore diameter of the metal skeleton to be 500 μm or less, a fine Al or Mg basis region surrounded by the metal skeleton can be made such that the area of contact between the basis region and the counterpart material can be reduced and, therefore, the frequency of the occurrence of seizing phenomenon can be reduced. Furthermore, by designing the pore diameter of the metal skeleton to be 350 μm or less such that the seizing area in the aforementioned basis region is reduced, the adhesion force at the occurrence of seizing between the aforementioned composite material and the counterpart material is reduced, and surface damage due to seizing can be suppressed accordingly.

When the pore diameter is smaller than 100 μm, there is a problem in that higher pressure is required for the impregnation of Al and Mg and, therefore, manufacture is difficult.

In the case of a composite material with Al or Mg, depending on the pore diameter of the metal skeleton, it may become a difficult-to-machine material such that a cutting edge of a cutting tool for working may be damaged. However, when the pore diameter of the metal skeleton is designed to be 500 μm or less, wear of the cutting tool can be reduced, since the metal skeleton itself becomes small.

In the present specification, a pore diameter of the porous metal body refers to an average pore (gas cavity) diameter, as used in general designation in the industry.

A method of manufacture of a metal porous body according to the present invention will be described below.

A slurry primarily containing an Fe oxide powder having an average particle diameter of 5 μm or less, at least one powder selected from metallic Cr, Cr alloys, and Cr oxides, a thermosetting resin, and a diluent is prepared. A coating of the slurry is applied to a resin core body of foam structure having a pore diameter of 625 μm or less and drying is performed, and thereafter, firing including a heat treatment at a temperature in the range of 950° C. to 1,350° C. is performed in a non-oxidizing atmosphere.

The reason for specifying the average particle diameter to be 5 μm or less with respect to the iron oxide powder as a starting material is that sinterability of the skeleton portion of the porous body during the later heat treatment step is thereby improved. When such a fine iron powder is used, the void area percentage in the cross section of the skeleton becomes 30% or less, and as a result, a porous body having excellent mechanical strength, heat resistance, and corrosion resistance that are adequate for the object of the invention is produced. The reason for specifying the pore diameter of the resin core body having the foam structure to be 625 μm or less is that the pore diameter of the porous metal body can thereby made to be 500 μm or less.

In the present invention, carbide is generated by the reaction with carbon produced from the thermosetting resin. According to this, in contrast to the case where the carbon component is added in the form of metal carbide from the start, the metal carbide becomes in the condition of being dispersed uniformly. The metal carbide phase produced by the method according to the present invention has an average grain size within the range of 2 μm to 50 μm, and exerts excellent effects on wear resistance, etc. By using the core body having the aforementioned pore diameter, final pore diameter can be controlled at 500 μm or less, and by filling the pores with an alloy of a light metal, such as Al and Mg, so as to achieve composition, particularly the seizing resistance is improved remarkably.

The aforementioned at least one metal selected from the group consisting of Ni, Cu, Mo, Al, P, B, Si, and Ti is mixed, in the state of a powder, into the slurry. As a result of sintering, these are alloyed with a base metal primarily containing Fe and Cr and, therefore, are absorbed into the skeleton of the porous metal body.

A preferable mode of the aforementioned heat treatment process includes a first heat treatment step in which, after a coating of slurry is applied, the resin component in the dried porous resin core body is carbonized in a non-oxidizing atmosphere, and a second heat treatment step in which heating is performed in a reducing atmosphere at a temperature in the range of 950° C. to 1,350° C. In this second heat treatment step, the metal oxide is reduced with the carbonized component generated in the first heat treatment step and, in addition, the Fe oxide and a part of at least one component selected from Cr, Cr alloys, and Cr oxides are converted into carbides, and furthermore, the reduced metal component is alloyed and is sintered simultaneously.

Points to be noted regarding the method of manufacture are the amount of compounding of the resin to become a carbon source for forming the carbide and firing conditions.

It is preferable to control the mass ratio within a specified range with respect to the Fe oxide and other oxide powders that are added into the slurry and the carbonized component generated from the resin component in the slurry and the resin core body through the aforementioned first heat treatment step. It is recommended to determine the compounding composition of the slurry based on that relationship. The method for determination thereof is based on the following Equation (1). That is, it is recommended that the product of X, which is a mass ratio of carbon residue that is able to remain in the skeleton of the porous metal body relative to the carbon that is generated from the resin component, and Y, which is the mass ratio of the resin component to oxygen contained in the oxides of Fe, Cr, and other metal at the time of the slurry preparation, be within the range satisfying the following Equation (1).

$$37<X\times Y<126 \quad (1)$$

X: rate of carbon residue (% by mass) of the resin component

Y: mass ratio of the resin component to oxygen contained in the oxide

The aforementioned rate of carbon residue of the resin component is the total of the rate of carbon residues generated from the total resin component of the thermosetting resin added to the slurry and the resin porous body to become an initial skeleton, etc. The rate of carbon residue, which is measured according to a method described in JIS K2270, refers to a ratio of the amount of the carbon residue component after carbonization to the initial resin weight (the total weight of the resin core body and the thermosetting resin component which is a diluent in the slurry). The amount of the oxides used in a trial calculation of the mass ratio Y is primarily based on the Fe oxide, although when the Cr oxide is further used, the amount based thereon is also included. By controlling the initial component ratio under such a condition, reduction of the oxides proceeds in a balanced manner during the second heat treatment step and, therefore, a metal porous body having excellent mechanical strength can be produced.

When the carbon content in the resulting porous metal body is controlled to the range of 0.1% or more and 3.5% or less, it is preferable that compounding be performed such that the compounding ratio of the oxide powder and the thermosetting resin satisfies the following Equation (2).

$$17<a\times b<37 \quad (2)$$

Wherein a is the rate of carbon residue of the thermosetting resin solution added to the slurry, and b is the mass ratio of the thermosetting resin solution added to the slurry to oxygen contained in the oxide.

The sintering condition must be appropriately changed in accordance with the carbon source contained in the resin component in the slurry and the amount of oxygen in the metal oxide.

The metal porous body thus produced has high toughness and wear resistance because the metal carbide phase is uniformly dispersed in the metal phase of the skeleton portion, and the metal carbide phase is composed of the carbide phase even at the interior part.

These porous metal bodies are suitable for combining by impregnating their pores with a melt of an Al alloy or a Mg alloy by injection. In particular, when the melt of the Al alloy or the Mg alloy is injected under a pressure of 98 kPa or more so as to form a compound metal, a preferable metallic composite material is produced, since the porous metal body and the Al alloy or the Mg alloy matrix are adhered adequately without unfilled gap.

When the melt is injected at a pressure lower than 98 kPa, air existing between the metal porous body skeletons is not completely purged and, therefore, void fault may occur inside the composite material.

Furthermore, it is possible to make an alloy suitable for a particular use by additionally including a third component other than the alloys of Fe and Cr. That is, when a powder composed of a third metal component or an oxide thereof is added into the original slurry, the heat resistance, corrosion resistance, wear resistance, and mechanical strength of the resulting metal porous body can be improved. Typical examples thereof include, Ni, Cu, Mo, Al, P, B, Si, and Ti. These third components may be added in any one of the forms in the condition of metal powder, oxide powder, and mixture thereof. In particular, the addition in the form of the oxide has the advantage of easy availability for a raw material powder.

When the aforementioned third material is added in the form of the oxide, regarding Y in the aforementioned Equation (1) and b in (2), oxygen contained in the oxide of this third material is also taken into consideration.

BEST MODE FOR CARRYING OUT THE INVENTION

Figure 1:
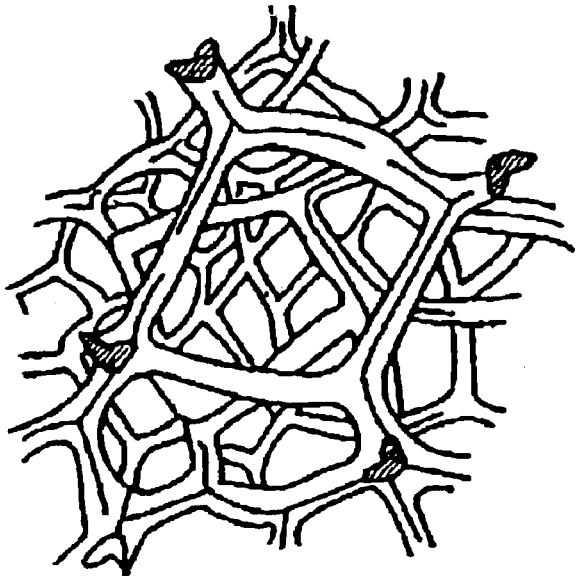
FIG. 1 is an enlarged schematic diagram of a metal porous body produced by the method of manufacture according to the present invention.
Figure 2:
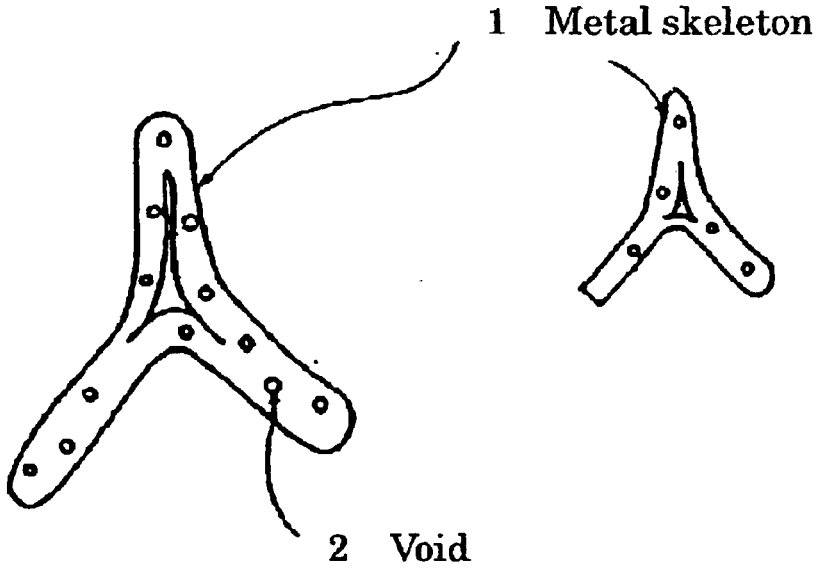
FIG. 2 is a diagram for explaining the skeleton cross section of a metal porous body.

FIG. 1 is a magnified diagram schematically showing a typical example of a porous metal body according to the present invention. Although the external appearance is nearly the same as a porous resin body, the skeleton cross section becomes as shown in FIG. 2 because of shrinkage during conversion into carbide and sintering, since after the skeleton of the porous resin body is coated with a slurry, this is dried, and thereafter, sintered, allowing voids 2 being included inside the metal skeleton 1.

Figure 3:
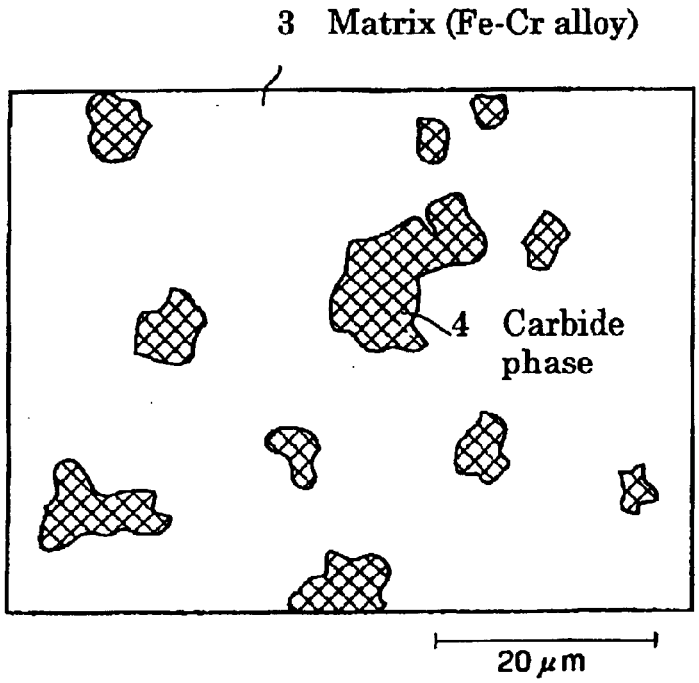
FIG. 3 is a diagram showing the existence of metal carbides dispersed in the skeleton cross section of a metal porous body according to the present invention.

FIG. 3 is a diagram schematically showing a typical example of a skeleton cross section of a porous metal body according to the present invention, and shows the condition in which metal carbide phases 4 are dispersed in a matrix 3 of an alloy phase containing Fe and Cr. As shown in FIG. 2, some voids may exist in the skeleton. However, these voids are omitted from FIG. 3. If addition is performed in the form of a carbide powder from the start, the carbide phases 4 are not dispersed adequately in the matrix 3 because the particles are excessively large. For example, the grain size of the carbide phase in that case becomes on the order of 100 $\mu$m at the maximum. However, the skeleton portion of the porous body according to the present invention is adhered adequately to the alloy phase matrix 3, since the carbide phases 4 are dispersed uniformly and more finely than that in the alloy phase matrix 3, and, therefore, high toughness characteristic can be achieved.

Figure 4:
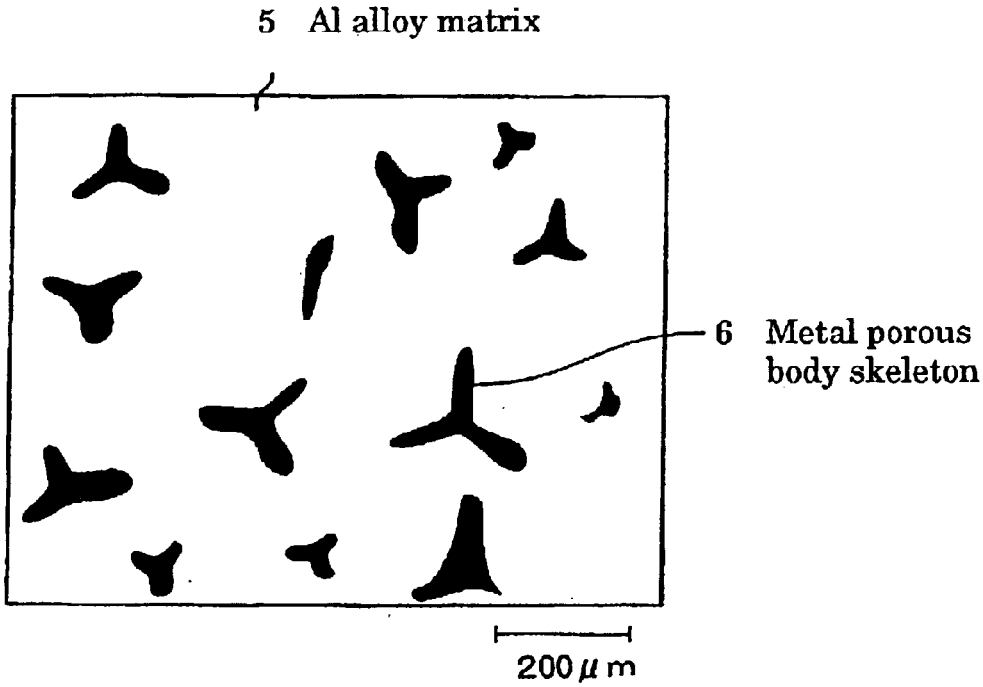
FIG. 4 is an enlarged cross section of a metallic composite material using a metal porous body according to the present invention.

FIG. 4 is a diagram schematically showing a typical example of a cross section (which is observed with an optical microscope) of a composite material according to the present invention, in which the porous metal body has been combined with an Al alloy. Although the internal composition of the skeletons 6 of the porous metal body cannot be observed due to reflected light, there are no recognizable gaps, etc. at the boundary with the Al alloy matrix 5 and, therefore, a composite is formed in the condition of adequate adherence. By forming such a texture, a metallic composite material having excellent wear resistance, which is characteristic of the metallic composite material, and excellent workability can be produced.

In the method of manufacture of a metal porous body according to the present invention, as a component of the slurry, Fe is not used, but an oxide powder thereof is used. At this time, the average particle diameter of the Fe oxide is specified to be 5 $\mu$m or less, and preferably, be 1 $\mu$m or less. According to this, the time required for reducing the interior of the particle is shortened and, in addition, sintering during firing becomes easy. Furthermore, as a result of the first heat treatment, the carbonized components generated from the resin are formed in the condition of being dispersed uniformly around the primary component particles containing Fe and Cr, and are reduced uniformly. As a result, the skeleton having a uniform composition and a relatively small porosity is likely to form.

As shown in FIG. 2, voids exist in the skeleton. When the porosity is large, the strength is reduced. In the present invention, by using a fine Fe oxide such as described above, the porosity, that is, the void area in terms of percentage relative to the cross-sectional area, can be controlled at 30% or less.

By making the particles fine, the coating layer of the slurry on the resin porous body can be formed densely and uniformly. Furthermore, since in the first heat treatment step, the formation of FeCr composite oxide is easy, reactions are accelerated during reduction-sintering. As a result, the heat-treatment time can be shortened. Since, by making the particles fine, the contact area of the FeCr composite oxide with carbon particles generated from the resin is increased, the reaction of conversion to carbide is accelerated and, therefore, carbon can be consumed uniformly, and adhesion of the carbon component to the furnace wall, which otherwise is likely to occur during sintering of a metal powder in a reducing atmosphere, becomes unlikely to occur. As a result, problems, for example, degradation of the sintering furnace, can be suppressed.

Regarding Cr to become an alloy component, metallic Cr, Cr alloy, or Cr oxide is used as a feed material, and it is recommended that regarding the composition after alloying, Cr is 30% by mass or less, and more preferably, in addition to this, the mass ratio of Fe to Cr (i.e., Fe/Cr) is within the range on the order of 1.5 to 20. When the amount of Cr exceeds 30% by mass, the mechanical strength as the metal porous body is reduced. From the viewpoint of formation of a uniform skeleton, the finer the raw material powder for Cr is the better in the same manner as in the aforementioned raw material to become an alloy component Fe. However, since the cost is increased as a metal powder becomes finer in particular, it is recommended to consider the particle size of the raw material powder in terms of the cost thereof, and in the case of metallic Cr, a powder having an average particle diameter of 40 $\mu$m or less is preferable. More preferably, when specified to be 10 $\mu$m or less, it is convenient for alloying with the Fe oxide. When it exceeds 40 $\mu$m, precipitation in the slurry, variations in coating, and the like are induced, therefore causing non-uniformity in the alloy composition. From the viewpoint as described above, an especially preferable starting material as the Cr component is $Cr_2O_3$ and an FeCr alloy.

When at least one metal powder of Ni, Cu, Mo, Al, P, B, Si, and Ti or an oxide powder thereof is added as the third component, the heat resistance, corrosion resistance, and mechanical strength as the metal porous body can be improved and, therefore, this is preferable. Although the amount at which the effects are exerted is different depending on the type of metal basis, preferably, it is 25% by mass or less in total amount in terms of element concentration in a product composition. When addition is performed at an amount exceeding 25% by mass, conversely, the aforementioned improvement of the metal skeleton is adversely affected.

An important point to note regarding the compounding ratio in the slurry is the proportion of the amount of oxygen in the oxides of Fe and Cr and, in the oxides as the aforementioned third component and the amount of the thermosetting resin. The role of the thermosetting resin is to function as a binder for adhering the slurry on the resin core body having a foam structure and to become a carbon source for forming the metal carbide. The thermosetting resin is carbonized during heating after application by coating, and the carbon after this carbonization also becomes the carbon source for metal carbide formation. Consequently, the amount of compounding thereof is related to the ratio of the amount of oxygen atoms existing as metal oxides in the slurry and the amount of carbon atoms in the thermosetting resin component. Since most of the resin to become the core body or other resin components is burned off during firing, the final contribution thereof to the amount of carbon residue in the porous metal body is small.

In consideration of these points, it is preferable that the compounding ratio of the resin component and the metal oxide in manufacture of the slurry be determined based on the rate of carbonization of the total resin components including the resin porous body to become the skeleton. Regarding the method of determination thereof, the weight of metal per unit volume is determined in accordance with the uses. The amount of resin components is determined from the amount of metals. At the same time, the amount of carbon residue derived from the thermosetting resin component to be added is determined based on the rate of carbon residue of the resin components. Design of the metal alloy is performed based on the characteristics, for example, heat resistance and mechanical strength, of the metal, and the amounts of Fe, Cr, the third metal to be added, etc., are calculated. The amount of oxides is determined by calculation from the raw material composition thereof, and the amount of oxygen to be treated is determined. The sort and the amount of the thermosetting resin used for the slurry is preferably adjusted based on the following Equation (1) in accordance with the firing step thereof.

$$37<X\times Y<126 \quad (1)$$

Wherein X is the rate of carbon residue (% by mass) of the resin component, and is a ratio of the amount of carbon after carbonization to the total resin components, such as a skeleton resin and a thermosetting resin used for the slurry. Y is the mass ratio of the total resin components to oxygen contained in the oxides of Fe and Cr, which are primary components, or the metal added as the aforementioned third component. When the third component is used in the form of metal powder, this is not counted. The resin components refer to the sum of the total resins including the skeleton resin and the thermosetting resin.

As described above, when the value produced by multiplying the rate of carbon residue (a) of the thermosetting resin by the mass ratio (b) of the thermosetting resin to oxygen contained in the oxides is specified to be within the range of more than 17 and less than 37 as indicated by the aforementioned Equation (2), the amount of carbon remaining in the skeleton of the resulting porous metal body ultimately can be adjusted within the range of 0.1% to 3.5%.

As described above, by taking the relationship of the amount between the resin component and the metal oxide in the slurry into consideration as indicated by the aforementioned Equations (1) and (2), the amount of carbon remaining in the metal porous body becomes very small and, therefore, excellent mechanical strength is achieved, and excellent heat resistance and corrosion resistance are also achieved. The metal texture in the skeleton becomes dense as well, and the void area in the cross section of the skeleton is also controlled at 30% or less. By controlling the amount of the slurry, etc., the volume percentage of the porous body can be controlled freely within the range of 3% or more.

A coating of the slurry is applied to the resin core body by the use of the slurry manufactured as described above. In the present invention, as described above, in order to make the pore diameter of the metal porous body 500 $\mu$m or less, a resin core body having a pore diameter of 625 $\mu$m or less is prepared, and the slurry is applied to this by coating. Preferably, a pore diameter is in the range of 100 to 350 $\mu$m. This enables a remarkable improvement of seizing resistance as described above when the composite material of the porous body and the light metal is formed.

Regarding the method of application of coating, preferably, after spraying of the slurry, dipping of the core body in the slurry, or the like is performed, the core body is squeezed with a roll, etc., in order to achieve a predetermined amount of coating. At this time, it is important to make a uniform coating such that the interior of the skeleton of the core body is also coated. In order to control the amount of coating, viscosity control of the slurry is also important. Such control becomes easy by using a liquid thermosetting resin or that made into a liquid state with a solvent. As the diluent, when the resin is water-soluble, water is used, and when the resin is water-insoluble, an organic solvent is used. The drying after coating is performed at a temperature lower than the temperature at which the resin core body is deformed.

The resin core body coated with the slurry and dried is fired in a non-oxidizing atmosphere so as to produce a porous metal body having a texture in which a skeleton surface primarily contains Fe and Cr and carbides are uniformly dispersed inside. Regarding the preferable mode of the firing step, as described above, two stages of heat treatments are performed under different conditions. Under the condition of the first heat treatment, the resin core body is removed, and simultaneously the thermosetting resin is carbonized, and in addition, the metal oxide is reduced by this carbon component, and a part of the metal component is converted into the carbide. Subsequently, the condition is changed to a high temperature, and a strong foam metal structure is brought about concurrently with sintering. According to this treatment, metal carbides are formed in the skeleton portion of the metal porous body, and a metal porous body in which these carbides are dispersed uniformly is produced.

In the aforementioned firing step, the temperature of the first heat treatment step is preferably at a lower side than that in the condition of forming a uniform metal composition, and a temperature in the neighborhood of 800° C. is recommended. Preferably, the temperature is within the range of 750° C. to 1,100° C. The temperature of the second heat treatment for sintering is specified to be within the range of 950° C. to 1,350° C., which is suitable for forming the alloy of Fe and Cr and for making the sintered body as described above, and preferably, within the range of 1,100° C. to 1,250° C. The neighborhood of 1,200° C. is especially desirable.

As another method, the aforementioned firing can also be performed by the following two heat treatment steps. That is, in the first heat treatment step, carbonization of the resin component is performed and, at the same time, the FeCr composite oxide is formed by the reaction of the Fe oxide and metallic Cr, Cr alloy, or Cr oxide. The formation of this FeCr composite oxide facilitates the reduction-sintering operation in the next step. Consequently, in the first heat treatment step, since carbonization of the resin component is required, it is preferable that the temperature of the atmosphere is 400° C. or more, but 900° C. or less in a non-oxidizing atmosphere. This is because when the temperature is less than 400° C., carbonization of the resin component consumes considerable time and is not cost-effective. In addition, carbonization does not proceed adequately, tar is likely to form in the next step and, therefore, disadvantages may occur in sintering. Furthermore, when exceeding 900° C., the reduction reaction of the aforementioned composite oxide proceeds and, therefore, it is unlikely that a dense metal structure can be achieved in the following second heat treatment step.

In this method, when the second heat treatment step is performed without undergoing the aforementioned first heat treatment step, carbonization of the resin is not performed adequately and, therefore, retention of the skeleton structure becomes inadequate, and crack, rupture, etc., of the skeleton may likely occur. Furthermore, since sintering may be performed while the aforementioned FeCr composite oxide is not formed adequately, defects due to the aforementioned oxide may occur in the skeleton after firing.

In the second heat treatment step, an oxidation-reduction reaction occurs between the FeCr composite oxide and the carbon component formed from the resin component in the preceding step. At the same time, sintering among metal particles in the metal skeleton proceeds. The atmosphere of the firing is desirably a reducing atmosphere, although it may be a vacuum. Typical examples of atmospheric gases which form the reducing atmosphere include, a hydrogen gas, ammonia decomposition gas, or mixture of hydrogen and nitrogen gases. When the sintering is performed in a vacuum, the partial pressure of oxygen is specified to be 0.5 Torr or less. The temperature of the atmosphere is desirably 950° C. or more, but 1,350° C. or less. Under this condition, the FeCr composite oxide is reduced easily with the help of active carbon formed by carbonization of the resin component, forms the skeleton and at the same time, becomes a FeCr alloy. When less than 950° C., reduction-sintering takes considerable time and is not cost-effective. When exceeding 1,350° C., the liquid phase appears during sintering, retention of the metal skeleton becomes impossible and, therefore, this is not preferable. A more preferable temperature is not less than 1,100° C. and not more than 1,250° C.

The skeleton of the metal porous body thus manufactured is formed from a uniform FeCr alloy so as to have a small porosity and to become dense and, therefore, mechanical strength is improved.

The pore diameter of the metal porous body manufactured as described above becomes 500 μm or less. As described above, when the pore diameter of the foamed resin to become a core body is made small, a smaller metal porous body is produced. The porous body according to the present invention has excellent mechanical strength, especially, bending strength and toughness, because the skeleton is made of an Fe and Cr base in which fine carbides are dispersed uniformly, as described above, and the porosity is small. Accordingly, even when the pore diameter becomes as small as 500 μm or less, the moldability into a preform is not degraded compared with the moldability of those having a pore diameter exceeding that. Furthermore, since the pore diameter is reduced, the bending strength is improved compared with the bending strength of those having a large pore diameter. For example, regarding those made of the same material, when the pore diameter is 790 μm, the bending strength is 0.17 MPa, while when the pore diameter becomes 500 μm or less, an excellent bending strength exceeding 0.45 MPa is achieved. Consequently, an increasing range of unprecedented uses as structure members can be highly anticipated.

Furthermore, the composite material according to the present invention is basically superior as a lightweight structure member having excellent durability particularly when a porous body having a volume percentage of 3% or more, but 30% or less is combined, since the pores of the porous body are filled, by the impregnation method as described above, with a light metal having excellent heat resistance and corrosion resistance as well as mechanical strength. In particular, as described above, the composite material provided by the present invention has excellent wear resistance because an area occupied by the light metal in an arbitrary cross section is controlled at an especially small level, and in addition, the composite material can comply with the weight reduction of various sliding portions because seizing resistance in particular is excellent during sliding.

The present invention will be specifically described below using Examples.

EXAMPLE 1

A slurry was prepared by mixing at a compounding ratio of 50% by mass of $Fe_2O_3$ powder having an average particle diameter of 0.7 μm, 23% by mass of FeCr (Cr 60%) alloy powder having an average particle diameter of 4 μm, 17% by mass of 65% phenol resin aqueous solution as a thermosetting resin, 2% by mass of CMC (carboxymethyl cellulose) as a dispersing agent, and 8% by mass of water. The slurry was applied by impregnation into a polyurethane foam having a thickness of 10 mm and a pore diameter of 600 μm. Excessively adhered slurry was squeezed out by a metal roll and is removed. Drying was performed in the atmosphere at 120° C. for 10 minutes. The sheets thus obtained were treated under the heat treatment conditions shown in Table I so that porous metal bodies were produced. The resulting porous metal bodies were examined in terms of the density, average porosity of the skeleton portion, 3-point bending strength, and oxidation increment rate which indicates heat resistance, and the results thereof are shown in Table 11. The pore diameter of the porous metal bodies produced was 480 μm.

TABLE I

| No. | First heat treatment step | Second heat treatment step |
|---|---|---|
| 1* | 700° C., 15 minutes, in $N_2$ | 900° C., 30 minutes, in $H_2$ |
| 2 | 700° C., 15 minutes, in $N_2$ | 1150° C., 30 minutes, in $H_2$ |
| 3 | 700° C., 15 minutes, in $N_2$ | 1250° C., 30 minutes, in $H_2$ |
| 4 | No treatment | 1250° C., 30 minutes, in $H_2$ |
| 5 | 850° C., 20 minutes, in Ar | 1150° C., 30 minutes, in a vacuum |
| 6 | 850° C., 20 minutes, in Ar | 1200° C., 30 minutes, in a vacuum |
| 7* | 850° C., 20 minutes, in Ar | 1400° C., 30 minutes, in a vacuum |

*Comparative example

Regarding No. 1, the temperature of the second heat treatment step was low, and regarding No.7, the temperature of the second heat treatment step was high. Therefore, these were inferior to the other metal porous bodies with respect to the aforementioned characteristics.

TABLE II

| No. | Density ($g/cm^3$) | Average porosity*1 of skeleton portion (%) | 3-Point bending strength (MPa) | Oxidation increment rate*2 (%) |
|---|---|---|---|---|
| 1 | 0.51 | 52 | 0.6 | 22.2 |
| 2 | 0.51 | 8 | 4.5 | 3.8 |
| 3 | 0.51 | 7 | 4.8 | 3.0 |
| 4 | 0.51 | 7 | 0.9 | 3.2 |
| 5 | 0.51 | 6 | 4.8 | 2.8 |
| 6 | 0.61 | 6 | 5.1 | 2.6 |
| 7* | 1.83 | 3 | 0.1 | 2.8 |

*The metal skeleton of No. 7 was melted during sintering, and the porous body structure could not be retained.
*1: Proportion of void portion area relative to the cross-sectional area in the metal skeleton cross section.
*2: Oxidation weight increment rate when kept in the atmosphere at 900° C. for 50 hours.

According to the aforementioned results, when the temperature of the second heat treatment step is low, the average porosity of the skeleton portion is increased, and the 3-point bending strength is reduced. Since the surface area is also increased, the heat resistance due to oxidation is reduced Conversely, when the temperature is excessively high, the metal skeleton cannot be retained, and although the density is increased, the 3-point bending strength is reduced. The density of the metal porous body depends on the amount of coating of the slurry. Consequently, the temperature of the second heat treatment is preferably 950° C. to 1,350° C., and it is further preferable that the heat treatment is performed with the two-stage step.

EXAMPLE 2

Slurries were prepared at a compounding ratio of 50% by mass of $Fe_2O_3$ powder having average particle diameters shown in Table III, 23% by mass of FeCr (Cr 60%) alloy powder having an average particle diameter of 8 μm, 17% by mass of 65% phenol resin aqueous solution as a thermosetting resin, 2% by mass of CMC as a dispersing agent, and 8% by mass of water. The slurries were each applied by impregnation into polyurethane foams having a thickness of 10 mm and a pore diameter of 340 μm. Excessive slurry was squeezed out by a metal roll and is removed. Subsequently, drying was performed in the atmosphere at 120° C. for 10 minutes. After the polyurethane and the phenol resin were carbonized by the proess of heat-treating in $N_2$ at 800° C. for 20 minutes, reduction-sintering was performed in $H_2$ at 1,200° C. for 30 minutes so that porous metal bodies of FeCr alloy were produced. The resulting porous metal bodies were examined with respect to the density, average porosity of the skeleton portion, 3-point bending strength, and oxidation increment rate, and the results thereof are shown in Table IV. The pore diameter of the porous metal bodies produced was 270 μm.

TABLE III

| No. | Average particle diameter (μm) |
|---|---|
| 11* | 8.9 |
| 12 | 5.0 |
| 13 | 1.0 |
| 14 | 0.5 |

*Comparative example

TABLE IV

| No. | Density (g/cm³) | Average porosity of skeleton portion (%) | 3-Point bending strength (MPa) | Oxidation increment rate (%) |
|---|---|---|---|---|
| 11* | 0.45 | 40 | 1.5 | 16.6 |
| 12 | 0.45 | 27 | 3.8 | 14.6 |
| 13 | 0.45 | 8 | 6.2 | 3.8 |
| 14 | 0.45 | 5 | 6.5 | 3.6 |

*Comparative example

According to Table III and Table IV, when the average particle diameter of the Fe oxide is large, the average porosity of the skeleton portion exceeds 30%, and the tensile strength is reduced. When the average particle diameter of the Fe oxide is increased, the surface area of the skeleton of the resulting metal porous body is also increased and, in addition, the density and the tensile strength of the metal are reduced. As a result, the oxidation increment rate, which is a measure of heat resistance, is increased. Therefore, the average particle diameter of the Fe oxide is preferably 5 μm or less, and more preferably, 1 μm or less.

EXAMPLE 3

Porous metal bodies were produced in a manufacture conditions similar to those in Example 2 except that an $Fe_2O_3$ powder having an average particle diameter of 0.7 μm was used and the amount of the phenol resin, which was a thermosetting resin in the slurry, was changed such that the rate of carbon residue was changed. The conditions represented by the rate of carbon residue X of the resin components and the mass ratio Y of the resin components to oxygen contained in the oxides are as shown in Table V. The resin components were a phenol resin, urethane foam, and CMC.

TABLE V

| No. | X* (% by mass) | Y* | X × Y* |
|---|---|---|---|
| 15 | 52 | 0.40 | 20.8 |
| 16 | 52 | 0.70 | 36.4 |
| 17 | 52 | 1.03 | 53.7 |
| 18 | 52 | 1.50 | 77.9 |
| 19 | 52 | 1.86 | 97.0 |
| 20 | 52 | 2.23 | 116.0 |
| 21 | 52 | 2.43 | 126.4 |
| 22 | 52 | 2.53 | 131.6 |

*For determination of X and Y by calculation, the measurement of the resin components was performed after the urethane foam had been coated with the slurry and drying had been performed.

The porous metal bodies formed under the slurry preparation conditions shown in Table V were examined in terms of the density, average porosity of the skeleton portion, 3-point bending strength, and oxidation increment rate, and the results are as shown in Table VI.

TABLE VI

| No. | Density (g/cm³) | Average porosity of skeleton portion (%) | 3-Point bending strength (MPa) | Oxidation increment rate (%) |
|---|---|---|---|---|
| 15 | 0.51 | 30 | 0.3 | 12.2 |
| 16 | 0.51 | 27 | 0.32 | 10.8 |
| 17 | 0.51 | 18 | 0.42 | 4.6 |
| 18 | 0.51 | 8 | 7.3 | 3.6 |
| 19 | 0.51 | 7 | 7.0 | 3.4 |
| 20 | 0.51 | 13 | 4.1 | 4.0 |
| 21 | 0.51 | 14 | 2.8 | 7.4 |
| 22 | 0.51 | 15 | 2.6 | 8.2 |

As is clear from the results shown in Table VI, differences in the characteristics of the metal porous bodies produced are brought about depending on the value of X×Y. It is clear from the comparison between Table V and Table VI that when the value of X×Y is smaller than 37 (the product of the rate of carbon residue of the resin components and the mass ratio of the resin components to oxygen contained in the oxides is smaller than 37), the characteristics of the metal porous bodies are degraded. In particular, the porosity of the skeleton cross section becomes somewhat large and, as a result, the oxidation increment rate tends to increase due to reduction of the tensile strength and reduction of the heat resistance. Conversely, when the value of X×Y is larger than 126 (the product of the rate of carbon residue of the resin components and the mass ratio of the resin components to oxygen contained in the oxides is larger than 126), there is a similar trend. Therefore, from the results of the present Example, it is clear that a more preferable metal porous body can be produced by adopting the condition in which the value of X×Y is more than 37, but less than 126.

EXAMPLE 4

Slurries were prepared with the following compositions: 50% by mass of $Fe_3O_4$ powder having an average particle diameter of 0.8 μm, 7.9% by mass of Cr powder having an average particle diameter of 5 μm, a third metal powder whose sort and amount are shown in Table VII, 12% by mass of 65% phenol resin aqueous solution, 2% by mass of dispersing agent (CMC), and water added thereto so as to total 100% by mass. The slurries were each applied by impregnation into polyurethane foams having a thickness of 15 mm and a pore diameter of 500 μm, and excessive slurry was squeezed out by a metal roll and removed. Subsequently, drying was performed in the atmosphere at 120° C. for 10 minutes. By heating in $N_2$ atmosphere at 700°

C. for 25 minutes, carbonization of the resin was performed and FeCr composite oxides were formed, then reduction-sintering was performed by heating in a vacuum with a partial pressure of oxygen of 0.5 Torr at 1,180° C. for 30 minutes such that porous metal bodies of FeCr alloy containing the aforementioned third metal components were produced. The porous metal bodies thus formed were evaluated in the same manner as in the aforementioned Examples, and the results thereof are shown in Table VIII.

The pore diameter of the porous metal bodies was 400 μm.

TABLE VII

| No. | Third metal powder | Compounding ratio (% by mass) |
|---|---|---|
| 23 | Ni | 14.6 |
| 24 | Ni | 3.5 |
| 25 | Mo | 0.5 |
| 26 | Si | 0.3 |
| 27 | Ni | 4.4 |
| | Cu | 0.8 |
| 28 | No addition | 0 |

TABLE VIII

| No. | Density (g/cm$^3$) | Average porosity of skeleton portion (%) | 3-Point bending strength (MPa) | Oxidation increment rate (%) |
|---|---|---|---|---|
| 23 | 0.55 | 5 | 5.3 | 3.9 |
| 24 | 0.55 | 6 | 4.8 | 5.4 |
| 25 | 0.55 | 8 | 4.5 | 6.2 |
| 26 | 0.55 | 6 | 4.4 | 5.8 |
| 27 | 0.55 | 9 | 4.7 | 4.6 |
| 28 | 0.55 | 8 | 4.5 | 10.3 |

As is clear from the results shown in Table VII and Table VIII, it is possible to modify the properties of a porous metal body by making the FeCr alloy include the third metal. Physical properties, mechanical strength, and heat resistance are not adversely affected provided that the amount of the third metal is not so large as to affect the compounding ratio by a large degree. Characteristics such as heat resistance and 3-point bending strength can be improved by increasing the third component.

EXAMPLE 5

Regarding the sample No. 24 used in the aforementioned Example 4, slurries were prepared in which the amounts of the metal oxide and the resin components were changed. Among the resin components, only the amount of the phenol resin in the slurry was changed. The other composition of the components was the same as that in the sample No. 24.

The compounding ratios indicated by X and Y are shown in Table IX.

TABLE IX

| No. | X* (% by mass) | Y* | X × Y* |
|---|---|---|---|
| 29 | 55 | 0.60 | 33.0 |
| 30 | 55 | 0.67 | 36.6 |
| 31 | 55 | 1.17 | 64.1 |
| 32 | 55 | 1.50 | 82.4 |
| 33 | 55 | 1.93 | 106.2 |
| 34 | 55 | 2.23 | 122.7 |
| 35 | 55 | 2.30 | 126.4 |
| 36 | 55 | 2.63 | 144.7 |

TABLE IX-continued

| No. | X* (% by mass) | Y* | X × Y* |
|---|---|---|---|

*Regarding determination of X and Y by calculation, measurement of the resin component was performed after the urethane foam had been coated with the slurry and drying had been performed.

Porous metal bodies were produced using these slurries under the same manufacture conditions as those in Example 4. The porous metal bodies were examined in the same manner as in the aforementioned Examples. The results thereof are shown in Table X. The pore diameter of the produced porous metal bodies was 400 μm.

TABLE X

| No. | Density (g/cm$^3$) | Average porosity of skeleton portion (%) | 3-Point bending strength (MPa) | Oxidation increment rate (%) |
|---|---|---|---|---|
| 29 | 0.51 | 27 | 2.4 | 12.4 |
| 30 | 0.51 | 23 | 2.5 | 9.6 |
| 31 | 0.51 | 7 | 4.8 | 5.8 |
| 32 | 0.51 | 6 | 5.0 | 5.6 |
| 33 | 0.51 | 8 | 4.5 | 5.4 |
| 34 | 0.51 | 12 | 2.6 | 8.6 |
| 35 | 0.51 | 14 | 2.4 | 10.0 |
| 36 | 0.51 | 17 | 2.0 | 14.2 |

As is clear from the results shown in Table IX and Table X, when the compounding ratio in which the value of X×Y is more than 37, but less than 126 is used, a superior metal porous body is formed.

EXAMPLES 6 TO 10

A slurry was prepared by mixing at a composition of 52% by mass of $Fe_2O_3$ powder having an average particle diameter of 0.6 μm, 23% by mass of FeCr (Cr 63%) alloy powder having an average particle diameter of 7 μm, 13% by mass of 65% phenol resin aqueous solution as a thermosetting resin, 1.5% by mass of dispersing agent (CMC), and 10.5% by mass of water. This slurry was applied by impregnation into polyurethane foam sheets having a thickness of 10 mm and a pore diameter of 340 μm. Excessively adhered slurry was squeezed out by a metal roll and removed during picking up. Drying was performed in the atmosphere at 120° C. for 10 minutes. The sheets were heat-treated under the conditions shown in Table XI so that porous metal bodies were produced. The characteristics of the porous metal bodies are shown in Table XII.

As for the evaluation of "minimum radius of curvature" shown in Table XII, one end of a plate-shaped porous metal body (140 mm×90 mm×3 mmt) was fixed, and the other end was bent so as to approach the fixed end such that the radius of curvature measured when a rupture occurred was defined as the "minimum radius of curvature".

A porous metal body such as that in Example 9 may be used for a product having a large radius of curvature without problems; however, it cannot be used for processing into a cylinder of 80 mm in diameter.

It is clear from the results shown in Table XII that although the density of the porous metal body is not varied depending on the carbon content, workability is reduced in the working of bending, since the minimum radius of curvature becomes more than 10 cm as the amount of carbon is increased. Regarding the hardness, it is clear that the hardness is increased with the increase in the amount of carbon residue. Herein, "carbon content" and "rate of carbon residue" will be described as follows.

Rate of carbon residue: Mass ratio of the remaining amount of urethane foam and thermosetting resin, which have been carbonized in the first stage heat treatment, to the total amount of resin components, for example, a skeleton resin and a thermosetting resin used for the slurry, in a process in which the heat treatment is performed in two separate stages.

Carbon content: Mass ratio of the amount of carbon remains after the second stage heat treatment to the porous metal body which is a final product, whereas most of the carbon is used for reduction of the oxides when the second heat treatment is performed at the aforementioned rate of carbon residue.

Since excellent workability and hardness are required of a porous metal body according to the present invention, the amount of carbon content must be correct.

TABLE XI

| No. | First heat treatment condition | Second heat treatment condition |
|---|---|---|
| Example 6 | 800° C., 5 minutes, in $N_2$ | 1200° C., 10 minutes, in $H_2$ |
| Example 7 | 800° C., 5 minutes, in $N_2$ | 1200° C., 30 minutes, in $H_2$ |
| Example 8 | 800° C., 5 minutes, in $N_2$ | 1200° C., 60 minutes, in $H_2$ |
| Example 9 | 1100° C., 10 minutes, in $N_2$ | 1200° C., 30 minutes, in a vacuum |
| Example 10 | 1100° C., 10 minutes, in $H_2$ | 1200° C., 30 minutes, in a vacuum |

TABLE XII

| No. | Density (g/cm$^3$) | Carbon content (% by mass) | Minimum radius of curvature*1 (cm) | Vickers hardness (Hv) |
|---|---|---|---|---|
| Example 6 | 0.82 | 1.1 | 4.7 | 210 |
| Example 7 | 0.82 | 0.8 | 3.0 | 198 |
| Example 8 | 0.82 | 0.4 | 2.4 | 185 |
| Example 9 | 0.82 | 2.6 | 14.3 | 300 |
| Example 10 | 0.82 | 1.8 | 10.1 | 224 |

*1 Minimum radius of curvature at which rupture occurs during bending.

EXAMPLES 11 TO 15

Various slurries were prepared in which the compounding ratio of the thermosetting resin was varied with reference to the slurry having the component composition used in Example 6 such that the mass ratio thereof relative to the metal oxides was changed (the compounding ratios of the thermosetting resin are shown in the second column of Table XIII). Porous metal bodies were produced using these slurries under the same conditions as those in Example 6 for the step of the slurry impregnation and the subsequent steps. The rate of carbon residue (a) of the thermosetting resin and the mass ratio (b) of the thermosetting resin to oxygen contained in the oxides were determined and are also shown in Table XIII.

The characteristics of the porous bodies thus produced are shown in Table XIV.

When the manufacturing conditions satisfy Equation (2), the carbon content in the porous metal body can be controlled in the range of 0.1% by mass to 3.5% by mass, the minimum radius of curvature of the porous metal body within that range is reduced, and various types of bending processing can be facilitated accordingly. When the value is 37 or more, the carbon content exceeds 3.5% by mass and, in addition, the minimum radius of curvature becomes large, and restriction in molding is increased. Furthermore, the hardness of the metal skeleton also tends to increase. It is clear from the aforementioned results that control of a preferable carbon content at 0.1% by mass or more, but 3.5% by mass or less can be achieved by controlling the value of a×b.

TABLE XIII

| No. | Thermosetting resin compounding ratio (% by mass) | Rate of carbon residue of resin a (% by mass)* | Mass ratio relative to oxygen contained in oxides b (—)* | a × b* |
|---|---|---|---|---|
| Example 11 | 6 | 42 | 0.38 | 16.1 |
| Example 12 | 8 | 42 | 0.51 | 21.5 |
| Example 13 | 10 | 42 | 0.64 | 26.9 |
| Example 14 | 12 | 42 | 0.79 | 33.3 |
| Example 15 | 16 | 42 | 1.02 | 42.9 |
| Example 16 | 18 | 42 | 1.15 | 48.4 |

*Weight of the thermosetting resin used for determination of a and b by calculation was assumed to be 65% of weight of phenol resin solution used, and was determined by calculation.

TABLE XIV

| No. | Density (g/cm$^3$) | Carbon content (% by mass) | Minimum radius of curvature*1 (cm) | Vickers hardness (Hv) |
|---|---|---|---|---|
| Example 11 | 0.82 | 0.002 | 6.4 | 130 |
| Example 12 | 0.82 | 0.15 | 2.1 | 154 |
| Example 13 | 0.82 | 0.38 | 2.8 | 193 |
| Example 14 | 0.82 | 0.34 | 4.2 | 285 |
| Example 15 | 0.82 | 4.1 | 16.4 | 331 |
| Example 16 | 0.82 | 4.5 | 27.2 | 624 |

*1 Minimum radius of curvature at which rupture occurs during bending.

EXAMPLES 17 TO 21

Slurries were prepared with the following compositions: 54% by mass of $Fe_2O_3$ powder having an average particle diameter of 0.5 μm, 16% by mass of FeCr alloy (Cr 63%) powder having an average particle diameter of 5 μm, 1.5% by mass of dispersing agent (CMC), and a 65% phenol resin aqueous solution, the amount thereof being shown in Table XV, and water added thereto so as to make 100% by mass in total.

These slurries were each impregnated into polyurethane foam sheets having a thickness of 12 mm and a pore diameter of 420 μm, and excessive slurry was squeezed out by a metal roll and removed. Subsequently, drying was performed in the atmosphere at 120° C. for 10 minutes. These sheets were heat-treated under the conditions of Example 9 shown in Table XI so that porous metal bodies were produced. The characteristics of the porous metal bodies thus produced are shown in Table XVI.

The pore diameter of the porous metal bodies was 340 μm.

The densities of the metal porous bodies of Examples 17 to 21 shown in Table XVI are different from the densities of the metal porous bodies of Examples 6 to 15 shown in Table XII and Table XIV. This is attributed to the difference in porosities, etc. of urethane foam sheets used as the raw materials. The relationships between the carbon content, minimum radius of curvature (indicating workability) and hardness are similar to the results shown in Table XIV. When the carbon content exceeds 3.5%, workability is reduced as is clear from data of the minimum radius of curvature shown in Table XVI. However, the metal porous body having such relatively high carbon residue causes no problem even when the degree of working is low, and is suitable for use in which wear resistance is essential. In a case such as Example 17 where the carbon content is low, excellent results may not occur by combining with a light alloy so as to produce a metallic composite material, since the hardness of the porous metal body is low.

TABLE XV

| No. | Thermosetting resin compounding ratio (% by mass) | Rate of carbon residue of resin a (% by mass)* | Mass ratio relative to oxygen contained in oxides b (—)* | a × b* |
|---|---|---|---|---|
| Example 17 | 8 | 38 | 0.49 | 18.7 |
| Example 18 | 10 | 38 | 0.62 | 23.4 |
| Example 19 | 12 | 38 | 0.74 | 28.1 |
| Example 20 | 14 | 38 | 0.86 | 32.8 |
| Example 21 | 16 | 38 | 0.99 | 37.5 |

*Weight of the thermosetting resin used for determination of a and b by calculation was assumed to be 65% of the weight of the phenol resin solution used, and was determined by calculation.

TABLE XVI

| No. | Density (g/cm$^3$) | Carbon content (% by mass) | Minimum radius of curvature*1 (cm) | Vickers hardness (Hv) |
|---|---|---|---|---|
| Example 17 | 0.71 | 0.13 | 2.1 | 149 |
| Example 18 | 0.71 | 0.33 | 1.5 | 163 |
| Example 19 | 0.71 | 2.1 | 5.2 | 210 |
| Example 20 | 0.71 | 2.5 | 8.8 | 273 |
| Example 21 | 0.71 | 3.8 | 16.3 | 314 |

*1 Minimum radius of curvature at which rupture occurs during bending.

MANUFACTURE EXAMPLE 1 OF METALLIC COMPOSITE MATERIAL

Figure 5:
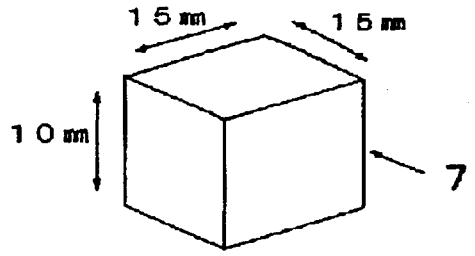
FIG. 5 are diagrams showing a roller pin wear tester and a test piece thereof in the Example according to the present invention.
Figure 5:
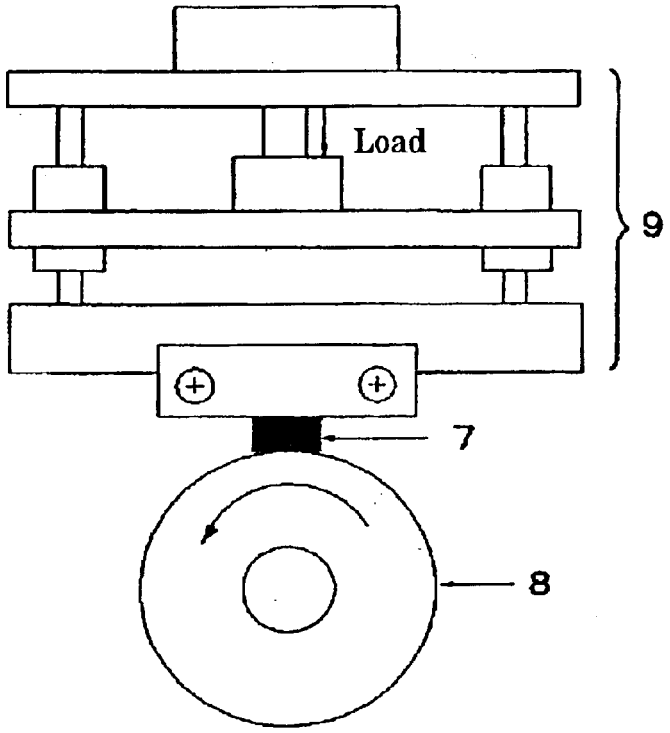
Figure 5:
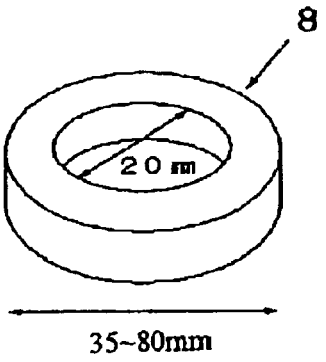

A part of each of the porous metal bodies produced in the aforementioned Examples 6 to 21 was put in a mold, and an aluminum alloy (AC8C) melt heated to 750° C. was impregnated into the porous body under a pressure of 39.2 MPa so that an aluminum composite material was produced. The resulting aluminum composite material was cut into a rectangular sample (15 mm×15 mm×10 mm) as shown in FIG. 5(*a*), and was subjected to a roller pin wear test with a tester shown in FIG. 5(*c*). Specifically, as shown in the drawings, the samples to be evaluated were worked into the shape shown in a diagram (a), put in contact with an opposing material in the shape of a roller as shown in a diagram (b), and evaluated in terms of the wear performance by rotating the roller under predetermined conditions.

The conditions of the roller pin wear test are as described below.

| | |
|---|---|
| Opposing material | Nitride steel having a hardness of Hv 1000 which is a rotating roller of 80 mm in diameter and 10 mm in width |
| Number of revolutions | 200 rpm |
| Pressing load | 60 kg |
| Time | 20 minutes |
| Lubricating oil | SAE10W30 |
| Dripping rate | 5 ml/min |

In this test, heat is generated because the aluminum composite material test piece prepared is pressed against the opposing material rotating perpendicularly in the condition that the pressing load is applied from above. Therefore, in order to prevent fusion and adhesion of the roller and the composite material sample, the lubricating oil was dropped at the portion where they were in contact with each other. The rotation of the opposing material was stopped 20 minutes after the load had been applied, and the wear depth of the samples was measured. The measured results are as shown in Table XVII. Herein, an aluminum alloy (AC8C) was cut into the shape of a rectangle and used as Comparative example 1.

In this roller pin wear test, although the combination with the roller material to be combined affects the test result, it is clear that, as shown in Table XVII, the composite materials according to the present invention exhibit markedly improved wear resistance. When the carbon content is extremely low, the effect of compositing is reduced, and the wear resistance is improved as the carbon content is increased. In this test, the operation of working the metal porous body of the Example is not performed. However, when complicated working is performed, workability becomes an important issue and, therefore, in the range in which the carbon content is high, it is necessary to adjust and select the carbon content considering the relative importance of wear resistance and workability.

TABLE XVII

| Metal porous body used | Wear depth ($\mu$m) |
|---|---|
| Example 6 | 21 |
| Example 7 | 26 |
| Example 8 | 31 |
| Example 9 | 18 |
| Example 10 | 19 |
| Example 11 | 52 |
| Example 12 | 29 |
| Example 13 | 23 |
| Example 14 | 17 |
| Example 15 | 16 |
| Example 16 | 15 |
| Example 17 | 45 |
| Example 18 | 28 |
| Example 19 | 21 |
| Example 20 | 18 |
| Example 21 | 15 |
| Comparative example 1 | 67 |

It is clear from the aforementioned results that the porous body according to the present invention itself has excellent wear resistance and mechanical strength because Fe carbides or FeCr carbides exist as a uniform dispersion phase in the alloy composed of Fe and Cr and, therefore, the skeleton itself has a high hardness. Consequently, the composite material according to the present invention, which is made by combination with the aluminum alloy using the porous body as a skeleton, has excellent wear resistance.

MANUFACTURE EXAMPLE 2 OF METALLIC COMPOSITE MATERIAL

In a manner similar to that in Manufacture example 1 of metallic composite material, the porous metal bodies produced in Examples 6 to 21 were combined with a magnesium alloy. A part of each of the metal porous bodies in Examples was put in a mold, and a magnesium alloy (AZ91A) melt heated to 750° C. was injected under a pressure of 24.5 MPa, thereby producing, a magnesium composite material. The resulting magnesium composite material was cut into the shape of a rectangle, and wear resistance was measured using a roller pin wear tester.

The conditions of the roller pin wear test are as described below.

| | |
|---|---|
| Opposing material | Nitride steel having a hardness of Hv 1000 which is nitride steel of a rotating roller 80 mm in diameter and 10 mm in width (the same as that in Manufacture example 1) |
| Number of revolutions | 300 rpm |
| Pressing load | 50 kg |
| Time | 15 minutes |
| Lubricating oil | SAE10W30 |
| Dripping rate | 5 ml/min |

This test method was also performed in a manner similar to that in Manufacture example 1 of metallic composite material, and the results are shown in Table XVIII. Comparative example 2 used here was the one prepared by cutting the magnesium alloy (AZ91A) into the shape of a rectangular. As shown in Table XVIII, when the carbon content is low, the value is brought close to the wear depth of Comparative example 2 in which combination was not performed. However, the wear resistance is improved as the carbon content is increased.

Regarding the correlation between the amount of carbon residue and the amount of wear, as in the case of the aluminum composite material, the hardness tends to be increased and the wear resistance improved as the carbon content is increased.

TABLE XVIII

| Metal porous body used | Wear depth ($\mu$m) |
|---|---|
| Example 6 | 58 |
| Example 7 | 62 |
| Example 8 | 68 |
| Example 9 | 43 |
| Example 10 | 47 |
| Example 11 | 100 |
| Example 12 | 81 |
| Example 13 | 64 |
| Example 14 | 55 |
| Example 15 | 53 |
| Example 16 | 48 |
| Example 17 | 99 |
| Example 18 | 60 |
| Example 19 | 53 |
| Example 20 | 49 |
| Example 21 | 40 |
| Comparative example 2 | 143 |

The porous body according to the present invention itself has excellent wear resistance and mechanical strength because Fe carbides or FeCr carbides exist as a uniform dispersion phase in the alloy composed of Fe and Cr and, therefore, the skeleton itself has a high hardness. Consequently, the composite material according to the present invention, which is made by combination with the Mg alloy using the porous body as a skeleton, has excellent wear resistance.

EXAMPLES 22 TO 26

Slurries were prepared with the following compositions: 50% by mass of $Fe_2O_3$ powder having an average particle diameter of 0.4 $\mu$m, 14.5% by mass of FeCr alloy (Cr 63%) powder having an average particle diameter of 5 $\mu$m, a metal powder whose sort and amount are shown in Table XIX, 12% by mass of 65% phenol resin aqueous solution, 1.5% by mass of dispersing agent (CMC) and water added in an amount to make 100% by mass in total. The slurries were each impregnated into a polyurethane foam having a thickness of 10 mm and a pore diameter of 340 $\mu$m and excessively adhered slurry was removed by a metal roll. Subsequently, drying was performed at 120° C. for 10 minutes. The sheets thus prepared were heat-treated under the conditions of Example 9 shown in Table XI so that porous metal bodies were produced. The density, carbon content, and Vickers hardness of the porous metal bodies are shown in Table XX.

TABLE XIX

| No. | Metal powder | Compounding ratio (parts by weight) |
|---|---|---|
| Example 22 | Ni (average particle diameter 2.8 $\mu$m) | 4.4 |
| Example 23 | Ni (average particle diameter 2.8 $\mu$m) | 6.6 |
| | Mo (average particle diameter 6.9 $\mu$m) | 1.1 |
| Example 24 | Cu (average particle diameter 1.8 $\mu$m) | 1.5 |
| Example 25 | Si (average particle diameter 9.1 $\mu$m) | 0.8 |
| Example 26 | Al (average particle diameter 8.7 $\mu$m) | 1.3 |

TABLE XX

| No. | Density (g/cm$^3$) | Carbon content (% by mass) | Minimum radius of curvature*1 (cm) | Vickers hardness (Hv) |
|---|---|---|---|---|
| Example 22 | 1.1 | 0.81 | 1.1 | 191 |
| Example 23 | 1.1 | 0.78 | 0.9 | 205 |
| Example 24 | 1.1 | 0.73 | 2.6 | 215 |
| Example 25 | 1.1 | 0.83 | 3.7 | 230 |
| Example 26 | 1.1 | 0.80 | 4.5 | 235 |

MANUFACTURE EXAMPLE 3 OF METALLIC COMPOSITE MATERIAL

Each of the porous metal bodies produced in the aforementioned Examples 22 to 26 was set in a mold, and an aluminum alloy (AC8A) melt heated to 760° C. was injected under a pressure of 20 kg/cm$^2$ so that aluminum composite materials were produced. The composite materials were subjected to a roller pin wear test, and the results thereof are shown in Table XXI.

The conditions of the roller pin wear test are as described below.

| | |
|---|---|
| Opposing material | Nitride steel having a hardness of Hv 1000 which is a rotating roller 80 mm in diameter and 10 mm in width (the same as that in Manufacture example 1) |
| Number of revolutions | 50 rpm |
| Pressing load | 100 kg |
| Time | 20 minutes |
| Lubricating oil | SAE10W30 |
| Dripping rate | 1 ml/min |

TABLE XXI

| Metal porous body used | Wear depth ($\mu$m) |
|---|---|
| Example 22 | 38 |
| Example 23 | 35 |
| Example 24 | 32 |
| Example 25 | 30 |
| Example 26 | 25 |
| Comparative example 3 | 105 |

Comparative example 3: Al alloy (AC8A)

EXAMPLES 27 TO 30

A slurry was prepared with the following compositions: 50% by mass of $Fe_2O_3$ powder having an average particle diameter of 0.4 μm, 14.5% by mass of FeCr alloy (Cr 63%) powder having an average particle diameter of 5 μm, 4.4% by mass of Ni powder having an average particle diameter of 2.8 μm, 12% by mass of 65% phenol resin solution, 1.5% by mass of dispersing agent (CMC) and water added thereto in an amount to make 100% by mass in total.

This slurry was impregnated into polyurethane foams shown in Table XXII and excessively adhered slurry was squeezed out by a metal roll and removed. Subsequently, drying was performed at 120° C. for 10 minutes. The sheets thus prepared were treated under the heat treatment condition of Example 9 shown in Table XI so that porous metal bodies were produced. The density, carbon content, pore diameter, and 3-point bending strength of the porous metal bodies thus produced are shown in Table XXIII. It is clear that the samples having a pore diameter of 0.5 mm or less exhibit a bending strength 1.5 or more times that of the sample having a pore diameter of 0.64 mm.

TABLE XXII

| No. | Pore diameter (μm) |
|---|---|
| Example 27 | 980 |
| Example 28 | 800 |
| Example 29 | 630 |
| Example 30 | 260 |
| Example 22 | 440 |

TABLE XXIII

| No. | Density ($g/cm^3$) | Carbon content (% by mass) | Pore diameter (μm) | 3-Point bending strength (MPa) |
|---|---|---|---|---|
| Example 27 | 1.1 | 0.73 | 790 | 1.7 |
| Example 28 | 1.1 | 0.76 | 640 | 3.0 |
| Example 29 | 1.1 | 0.76 | 500 | 4.5 |
| Example 30 | 1.1 | 0.82 | 210 | 6.9 |
| Example 22 | 1.1 | 0.78 | 350 | 5.4 |

MANUFACTURE EXAMPLE 4 OF METALLIC COMPOSITE MATERIAL

Each of the metal porous bodies produced in the aforementioned Example 22 and Examples 27 to 30 was set in a mold and, an aluminum alloy (AC8A) melt heated to 760° C. was injected under a pressure of 20 $kg/cm^2$, thereby producing an aluminum composite material. A seizing test was performed on the composite materials thus produced, and the results thereof are shown in Table XXIV.

The conditions of the seizing test are as described below.

| | |
|---|---|
| Opposing material | Nitride steel, diameter 11.3 mm, and tip R = 10 mm |
| Load | Loading is started at 1 kgf, and load is increased by 1 kgf on a minute basis |
| Stroke | 50 mm |
| Test speed | 200 cpm |
| Atmosphere | Coating of oil (SAE10W-30) and, thereafter, wiping |

TABLE XXIV

| No. | Seizing time (sec) |
|---|---|
| Example 27 | 210 |
| Example 28 | 265 |
| Example 29 | 380 |
| Example 30 | 720 |
| Example 22 | 520 |

INDUSTRIAL APPLICABILITY

As described above, according to the method of manufacture of the present invention, the metal porous body of the FeCr alloy, in which metal carbides are uniformly dispersed, can be produced and, in addition, can have excellent characteristics with respect to strength and wear resistance. Furthermore, the metal porous body, in which the third metal for improving characteristics of the metal porous body is alloyed, can also be produced.

The porous metal body according to the present invention has adequate workability and hardness obtained by uniformly dispersing metal carbide phases in the skeleton and, therefore, is also suitable for the skeleton to produce a composite material with an alloy primarily containing a light metal, such as Al or Mg. The composite material using a porous metal body of the present invention has improved wear resistance, and it is also possible to work the composite material appropriately according to use. In particular, when the porous metal body whose pore diameter is controlled at a small level of 500 μm or less is used as the skeleton of a composite material produced by combination with a light metal, the composite material exhibits markedly improved seizing resistance when used as a sliding member.

What is claimed is:

1. A porous metal body having a foam structure with a pore diameter of 500 μm or less and comprising an alloy including Fe and Cr, said alloy including Cr carbide and/or FeCr carbide uniformly dispersed therein.

2. A porous metal body according to claim 1, wherein the carbon content in the porous metal body is not less than 0.1% by mass and not more than 3.5% by mass.

3. A porous metal body according to claim 1, wherein the porous metal body further includes at least one selected from the group consisting of Ni, Cu, Mo, Al, P, B, Si, and Ti.

4. A method of manufacturing a porous metal body, comprising the steps of:

preparing a slurry primarily containing an Fe oxide powder having an average particle diameter of 5 μm or less, at least one powder selected from metallic Cr, Cr alloys, and Cr oxides powders, a thermosetting resin, and a diluent;

applying a coating of the slurry to a resin core body of a foam structure having a pore diameter of 625 μm or less and performing drying; and performing firing, including a heat treatment step at a temperature in the range of 950° C. to 1,350° C., in a non-oxidizing atmosphere.

5. A method of manufacturing a porous metal body according to claim 4, wherein the firing is performed in two steps comprising:

a first heat treatment step in which a resin core body is removed while a thermosetting resin is carbonized, and a metal oxide is reduced by the resulting carbon while a part of metal component is converted into carbide;

and a subsequent second heat treatment step in which a sintered body having a strong foam metal structure is formed by heating to a high temperature in the range of 1,100° C. to 1,350° C.

6. A method of manufacturing a porous metal body according to claim 4, wherein the firing is performed in two steps comprising:

a first heat treatment step, in which a resin component is carbonized in a non-oxidizing atmosphere; and a second heat treatment step in which a metal oxide is reduced in a reducing atmosphere at a temperature of not less than 950° C. and not more than 1,350° C. by the carbon produced in the first step, while a part of metal component is converted into carbide and, thereafter, the reduced metal is alloyed and sintered to have a strong foam metal structure.

7. A method of manufacturing a porous metal body according to claim 4, wherein at least one powder selected from the group consisting of Ni, Cu, Mo, Al, P, B, Si, and Ti and an oxide powder thereof are further mixed into a slurry to be kneaded.

8. A method of manufacturing a porous metal body according to claim 5, wherein at least one powder selected from the group consisting of Ni, Cu, Mo, Al, P, B, Si, and Ti and an oxide powder thereof are further mixed into a slurry to be kneaded.

9. A method of manufacturing a porous metal body according to claim 6, wherein at least one powder selected from the group consisting of Ni, Cu, Mo, Al, P, B, Si, and Ti and an oxide powder thereof are further mixed into a slurry to be kneaded.

10. A method of manufacturing a porous metal body according to claim 4, wherein the compounding ratio of resin component and oxide powder is determined such that the rate of carbon residue of the resin component and the mass ratio of the resin component to oxygen contained in the oxide are within the range satisfying the following Equation (1), $$37<X\times Y<126 \quad (1)$$

where, X: rate of carbon residue (% by mass) of the resin component

Y: mass ratio of the resin component to oxygen contained in the oxide.

11. A method of manufacturing a porous metal body according to claim 5, wherein die compounding ratio of resin component and oxide powder is determined such that the rate of carbon residue of the resin component and the mass ratio of the resin component to oxygen contained in the oxide are within the range satisfying the following Equation (1), $$37<X\times Y<126 \quad (1)$$

where X: rate of carbon residue (% by mass) of the component

Y: mass ratio of the resin component to oxygen contained an the oxide.

12. A method of manufacturing a porous metal body according to claim 6, wherein the compounding ratio of resin component and oxide powder is determined such that the rate of carbon residue of the resin component and the mass ratio of the resin component to oxygen contained in the oxide are within the range satisfying the following Equation (1), $$37<X\times Y<126 \quad (1)$$

where, X: rate of carbon residue (% by mass) of the resin component

Y: mass ratio of die resin component to oxygen contained in the oxide.

13. A method of manufacturing a porous metal body according to claim 4, wherein the compounding of the thermosetting resin and oxide powders is performed such that the rate of carbon residue of a solution containing the thermosetting resin and the mass ratio of the solution containing the thermosetting resin to oxygen containing in die oxides are within the range satisfying the following Equation (2), $$17<a\times b<37 \quad (2)$$

where, a: rate of carbon residue (% by mass) of the solution containing the thermosetting resin b: mass ratio of the solution containing the thermosetting resin to oxygen contained in the oxide solution containing the thermosetting resin: that in which the thermosetting resin is dissolved in water or a solvent.

14. A method of manufacturing a porous metal body according to claim 5, wherein the compounding of the thermosetting resin and oxide powders it performed such that the rate of carbon residue of a solution containing the thermosetting resin and the mass ratio of the solution containing the thermosetting resin to oxygen contained in the oxides are within the range satisfying the following Equation (2), $$17<a\times b<37 \quad (2)$$

where, a: rate of carbon residue (% by mass) of the solution containing the thermosetting resin b: mass ratio of the solution containing the thermosetting resin to oxygen contained in the oxide solution containing the thermosetting resin: that in which the thermosetting resin is dissolved in water or a solvent.

15. A method of manufacturing a porous moist body according to claim 6, wherein the compounding of the thermosetting rosin and oxide powders is performed such that the rate of carbon residue of a solution containing the thermosetting resin and the mass ratio of the solution containing the thermosetting resin to oxygen contained in the oxides are within the range satisfying the following Equation (2), $$17<a\times b<37 \quad (2)$$

where, a: rate of carbon residue (% by mass) of the solution containing the thermosetting resin b: mass ratio of the solution containing the thermosetting resin to oxygen contained in the oxide solution containing the thermosetting resin; that in which the thermosetting resin is dissolved in water or a solvent.

16. A metallic composite material, wherein the pores of the porous metal body according to claim 1 are filled with an Al alloy or a Mg alloy.

17. A metallic composite material, wherein the pores of the porous metal body according to claim 2 are filled with an Al alloy or a Mg alloy.

18. A metallic composite material, wherein the porous of the porous metal body according to claim 3 ate filled with an Al alloy or a Mg alloy.

19. A method of manufacturing metallic composite material, comprising the step of impregnating and injecting, wider a pressure of 98 KPa or more, a melt of Al alloy or Mg alloy into the pores of the porous metal burly produced by the method of manufacture according to claim 4.

20. A method of manufacturing a metallic composite material, comprising the step of impregnating and injecting, under a pressure of 98 KPa or more, a melt of Al alloy or Mg alloy into the pores of the porous metal body produced by the method of manufacture according to claim 5.

21. A method of manufacturing a metallic composite material, comprising the steps of impregnating and injecting, under a pressure of 98 KPa or more, a melt of Al alloy or Mg alloy into die pores of the porous metal body produced by the method of manufacture according to claim 6.

22. A metallic composite material, wherein the skeleton surface of the porous metal body according to claim 1 is coated with at least one solid lubricant selected from the group consisting of graphite, molybdenum disulfide, tungsten disulfide, boron nitride, molybdenum trioxide, and iron oxide, and furthermore, the ports thereof are filled with on Al alloy or a Mg alloy.

23. A metallic composite material wherein the skeleton surface of the porous metal body according to claim 2 is coated with at least one solid lubricant selected from the group consisting of graphite, molybdenum disulfide, tungsten disulfide, boron nitride, molybdenum trioxide, and iron oxide, and furthermore, the pores thereof are filled with art Al alloy or a Mg alloy.

24. A metallic composite material, wherein the skeleton surface of the porous metal body according in claim 3 is coated with at least one solid lubricant selected from the group consisting of graphite, molybdenum disulfide, tungsten disulfide, boron nitride, molybdenum trioxide, and iron oxide, and furthermore, the pores thereof are filled with an Al alloy or a Mg alloy.

25. A method of manufacturing a metallic composite material, comprising the steps of:

coating the skeleton surface of the porous metal body produced by the method of manufacture according to claim 4 with as least one solid lubricant selected from the group consisting of graphite, molybdenum disulfide, tungsten disulfide, boron nitride, molybdenum trioxide, and iron oxide; and impregnating and injecting a melt of Al alloy or Mg alley into the pores thereof under a pressure of 98 KPa or more.

26. A method of manufacturing a metallic composite material, comprising the steps or:

coating the skeleton surface of the porous metal body produced by the method of manufacture according to claim 5 with at least one solid lubricant selected from the group consisting of graphite, molybdenum disulfide, tungsten disulfide, boron nitride, molybdenum trioxide, and iron oxide: and impregnating and injecting a well of Al alloy or Mg alloy into the pores thereof under a pressure of 98 KPa or more.

27. A method of manufacturing a metallic composite material, comprising the steps of:

coating the skeleton surface of the porous metal body produced by the method of manufacture according to claim 6 with as least one solid lubricant selected from the group consisting of graphite, molybdenum disulfide, tungsten disulfide, boron nitride, molybdenum trioxide, and iron oxide; and impregnating and injecting a melt of Al alloy or Mg alley into the pores thereof under a pressure of 98 KPa or more.

* * * * *